US006745401B1

(12) United States Patent
David

(10) Patent No.: US 6,745,401 B1
(45) Date of Patent: Jun. 8, 2004

(54) WADER HAVING REMOVABLE INSULATION

(76) Inventor: Steve David, 2411 Dolly Ridge Rd., Birmingham, AL (US) 35243

( * ) Notice: Subject to any disclaimer, the term of this patent is extended or adjusted under 35 U.S.C. 154(b) by 6 days.

(21) Appl. No.: 10/037,364

(22) Filed: Jan. 4, 2002

(51) Int. Cl.[7] ..... A41D 13/02
(52) U.S. Cl. ..... 2/82; 2/227
(58) Field of Search ..... 2/82, 227, 79, 2/81, 232, 242, 69, 272, 69.5, 456, 458

(56) References Cited

U.S. PATENT DOCUMENTS 4,282,608 A * 8/1981 Amberg ..... 2/227
4,805,244 A * 2/1989 Scott ..... 2/272
5,022,096 A 6/1991 Pacanowsky
5,711,031 A 1/1998 Clement
6,154,884 A 12/2000 Dehner
6,280,807 B1 8/2001 Shih
6,317,893 B1 * 11/2001 Walton ..... 2/227

* cited by examiner

*Primary Examiner*—Tejash Patel
(74) *Attorney, Agent, or Firm*—Thomas, Kayden, Horstemeyer & Risley, L.L.P.

(57) ABSTRACT

A wader includes a wader leg and a leg insulator. The leg insulator is placed in contact with the wader leg and provides thermal insulation for a user's leg when the user is wearing the wader. However, the leg insulator can be easily and conveniently removed from the wader leg while the user's leg is positioned within the wader leg. Therefore, it is not necessary for the user to remove the wader in order to reduce the amount of thermal insulation provided to his or her leg.

7 Claims, 5 Drawing Sheets

WADER HAVING REMOVABLE INSULATION

BACKGROUND OF THE INVENTION

1. Field of the Invention

The present invention generally relates to waders and, in particular, to a wader having a leg insulator capable of being removed while a user is wearing the wader.

2. Related Art

Waders are typically used to enable fishermen, hunters, and the like to wade through water, such as streams or rivers, for example. A wader is a garment that is worn around a user's feet and legs. Many waders also cover the user's waist and a portion of the user's chest. Waders are typically comprised of waterproof material and isolate the user from surrounding water in order to keep the user dry as he or she wades through the water.

Although waders provide some thermal insulation, user's typically must wear additional garments in order to stay warm especially during early morning hours before or just after the Sun has risen. However, as the Sun rises and begins to warm the environment, a user may desire to shed some of the garments being worn for thermal insulation. In order to shed such garments, the user typically must shed his or her wader first. After removing one or more garments, the user may again don the wader and continue his or her activities. Unfortunately, waders are relatively burdensome to remove and don. Thus, a user often must choose between enduring uncomfortable temperatures or enduring the burdens of removing and donning the wader that he or she is wearing.

SUMMARY OF THE INVENTION

The present invention overcomes the inadequacies and deficiencies of the prior art as discussed hereinbefore. Generally, the present invention provides a wader that enables a user to easily and conveniently change the amount of thermal insulation provided to his or her legs.

A wader in accordance with the present invention includes a wader leg and a leg insulator. The leg insulator is placed in contact with the wader leg and provides thermal insulation for a user's leg when the user is wearing the wader. However, the leg insulator can be easily and conveniently removed from the wader leg while the user's leg is positioned within the wader leg. Therefore, it is not necessary for the user to remove the wader in order to reduce the amount of thermal insulation provided to his or her leg.

The present invention can also be viewed as providing a method for enabling a user to easily and conveniently change the amount of thermal insulation provided to his or her legs. The method can be broadly conceptualized by the following steps: providing a wader, the wader having a wader leg; contacting the wader with a leg insulator; inserting a user's leg into the wader leg; positioning the leg insulator such that the leg insulator thermally insulates the user's leg when the user's leg is inserted into the wader leg; and removing the leg insulator from the wader leg while the user's leg is inserted into the wader leg.

Various features and advantages of the present invention will become apparent to one skilled in the art upon examination of the following detailed description, when read in conjunction with the accompanying drawings. It is intended that all such features and advantages be included herein within the scope of the present invention and protected by the claims.

BRIEF DESCRIPTION OF THE DRAWINGS

The invention can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

DETAILED DESCRIPTION OF THE INVENTION

Figure 1:
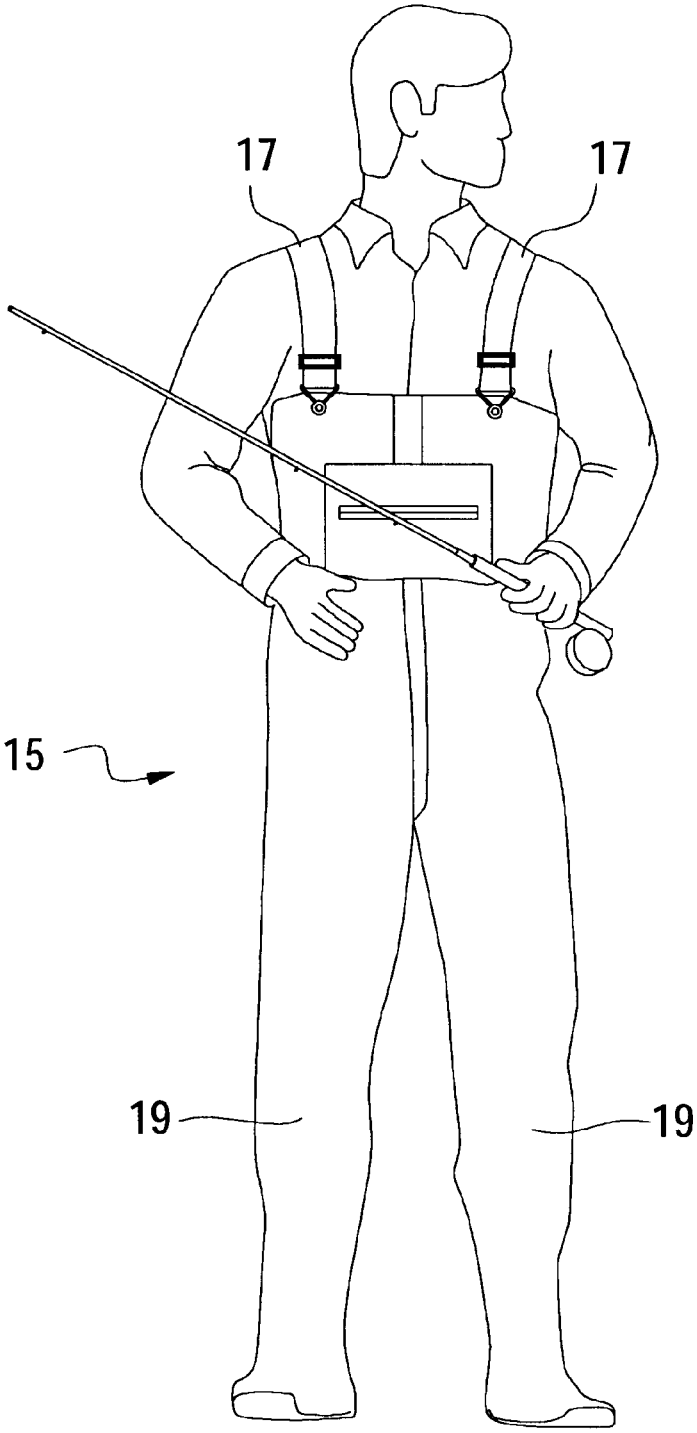
Fig. 1 Prior Art
FIG. 1 is a diagram illustrating a wader in accordance with the prior art.

FIG. 1 depicts a conventional wader 15. The wader 15 shown by FIG. 1 covers a user's body from his or her chest to his or her feet and is supported by a pair of suspenders 17. Furthermore, the wader 15 is comprised of waterproof material. Therefore, the user may wade into water up to his or her chest with the wader 15 isolating the user's body from the water.

The water that the user wades through is typically cold, and the user may desire to have his or her legs thermally insulated, to a degree, from the cold water. The portions of the wader 15 covering the user's legs provide some thermal insulation. Note that the portions of the wader 15 covering the user's legs will be referred to hereafter as "wader legs 19." However, the amount of thermal insulation desired may change depending on environmental conditions, which often vary. Thus, the wader legs 19 are not typically designed to provide significant thermal insulation allowing the user to control the amount of thermal insulation between the water and his or her legs by wearing garments (e.g., pants) of his or her choosing underneath the wader legs 19.

Environmental conditions may change after the user has donned the wader 15. Indeed, in many circumstances, the user may wish to remove one or more leg garments due to rising environmental temperatures. Unfortunately, to remove such garments, the user usually must remove the wader 15 first, and the process of removing and donning the wader 15 is often a burdensome task.

Figure 2:
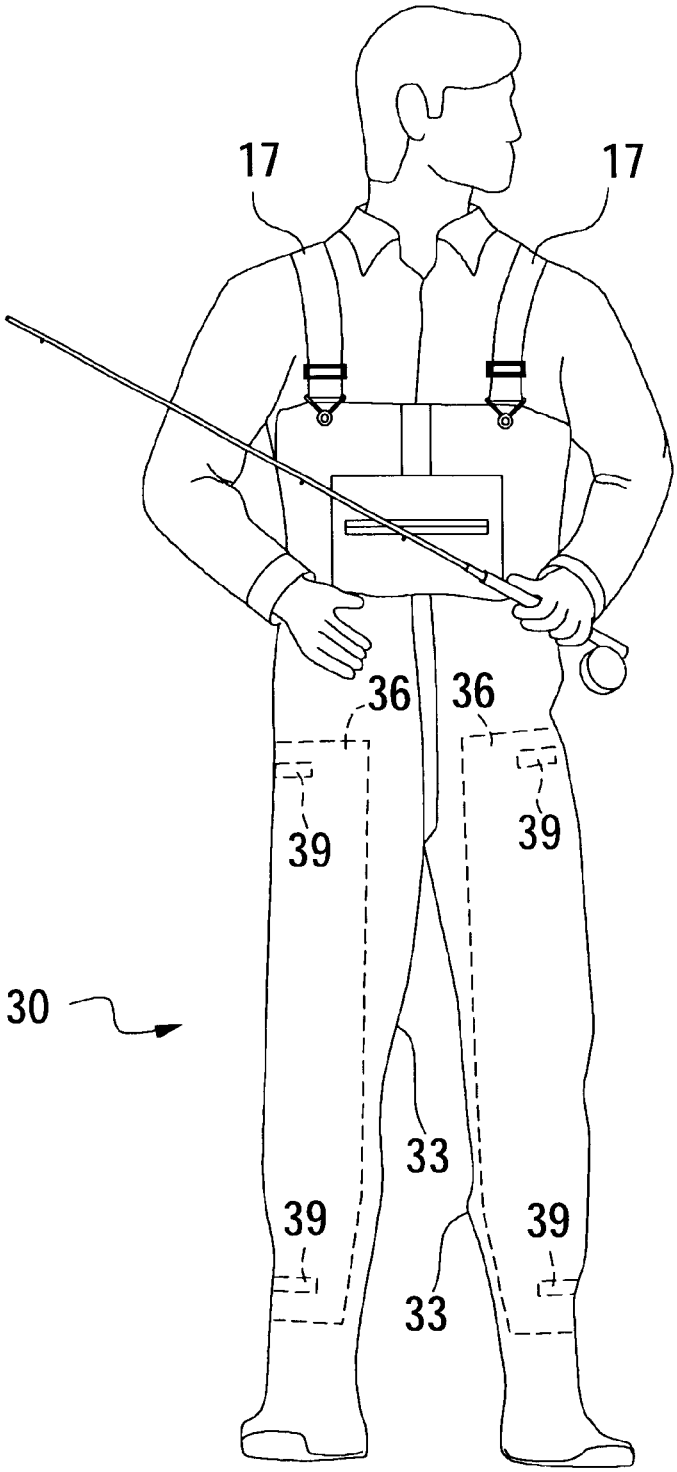
FIG. 2 is a diagram illustrating an exemplary wader in accordance with a preferred embodiment of the present invention.

FIG. 2 depicts a wader 30 having wader legs 33 in accordance with an exemplary embodiment of the present invention. The wader 30 may be identical to the conventional wader 15 depicted in FIG. 1 except that the wader 30 of the present invention includes one or more leg insulators 36 inserted within the wader legs 33. Each leg insulator 36 covers a portion of one of the user's legs and provides the user's leg with additional thermal insulation.

In the preferred embodiment, each leg insulator 36 extends from the front of a user's leg to at least the back of the user's same leg, although it is possible for one or more of the leg insulators 36 to cover different portions of the user's leg in other embodiments. An exemplary three-dimensional view and a top view of a leg insulator 36 in accordance with the preferred embodiment are respectively shown via FIGS. 3 and 4. The leg insulators 36 may be comprised of any material or combination of materials. However, it may be desirable for the leg insulators 36 to be comprised of a flexible and comfortable material, such as wool, for example, that also provides significant thermal insulation.

In the preferred embodiment, each leg insulator 36 is detachably coupled to the inner portion of one of the wader legs 33 via one or more attachment mechanisms 39. The attachment mechanisms 39 may be any suitable devices for detachably coupling a leg insulator 36 to the inner portion of a wader leg 33. An example of a suitable attachment mechanism 39 is a velcro strip. In such an example, the inner portion of a wader leg 33 where a leg insulator 36 is to be detachably coupled includes a velcro strip that adheres to the attachment mechanism 39 when the attachment mechanism 39 is engaged with the velcro strip of the wader leg 33. In another example, the attachment mechanism 39 may be implemented as a hook or a hoop. In this regard, the inner portion of the wader leg 33 may include a hook that may be passed through the attachment mechanism 39, which in this case is implemented as a hoop, in order to detachably couple the leg insulator 36 to the wader leg 33. Alternatively, the inner portion of the wader leg 33 may include a hoop, and the attachment mechanism 39, which in this case is implemented as a hook, may be passed through the hoop in order to detachably couple the leg insulator 36 to the wader leg 33. Note that the attachment mechanism 39 may be employed via other types of devices in other embodiments.

It should also be noted that the attachment mechanisms 39 are not necessary features of the present invention and may be removed, if desired. In this regard, the leg insulators 36 may be positioned within the wader legs 33 without detachably coupling the leg insulators 36 to the wader legs 33. When the user walks into water, the pressure exerted on the user's legs from the water generally holds the leg insulators 36 in place relative to the wader legs 33 and to the user's legs. Furthermore, in alternative embodiments, the leg insulators 36 may be detachably attached to the user's legs instead of the wader legs 33. For example, a belt (not shown) wrapped around the upper portion of a leg insulator 36 and a user's leg may be utilized to secure the leg insulator 36 to the user's leg.

Figure 3:
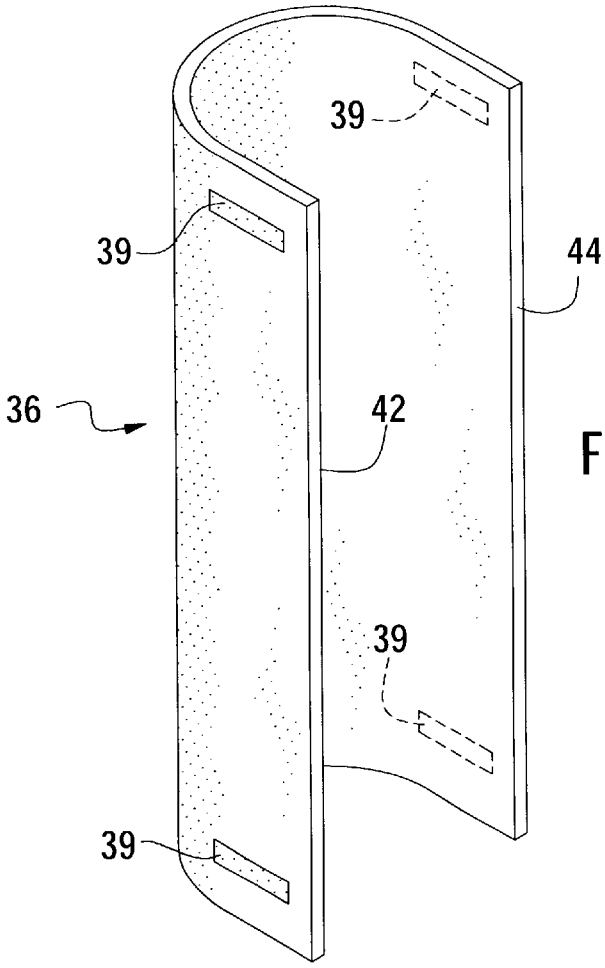
FIG. 3 is a diagram illustrating a three-dimensional view of a leg insulator depicted in FIG. 2.
Figure 4:
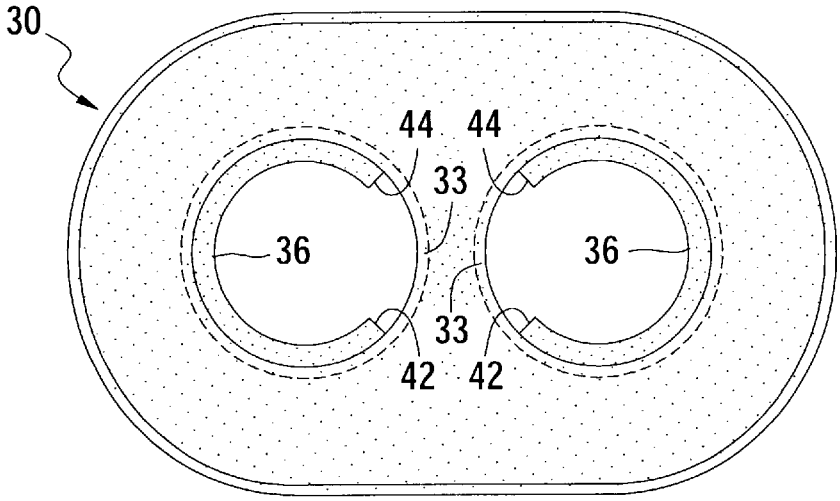
FIG. 4 is a diagram illustrating a top view of the wader depicted in FIG. 2.

As shown by FIGS. 2–4, the preferred embodiment of the wader 30 includes multiple attachment mechanisms 39 located at the top of each leg insulator 36 and multiple attachment mechanisms 39 located at the bottom of each leg insulator 36. However, other numbers and positions of the attachment mechanisms 39 can be employed without departing from the principles of the present invention. Indeed, as set forth above, it is not necessary for the attachment mechanisms 39 to even be employed in implementing the present invention.

If the user becomes uncomfortably warm while wearing the wader 30, the user may remove one or more of the leg insulators 36. This can be conveniently accomplished while the user's legs are still in the wader legs 33. In this regard, the user may simply grab the top of a leg insulator 36 and pull the leg insulator 36 out of the wader leg 33 and out of the wader 30 entirely while wearing the wader 30. In order to reach into the wader 30 and grab the leg insulator 36, it may be helpful for the user to unhook one or more of the suspenders 17. However, it is not necessary for the user to remove his or her leg from the wader leg 33 in which the removed leg insulator 36 originally resided.

Furthermore, when the leg insulator 36 is detachably coupled to the wader leg 33, it may be necessary for the user to detach the leg insulator 36 from the wader leg 33. For velcro attachment mechanisms 39, the foregoing may be accomplished by pulling the leg insulator 36 away from the wader leg 33. For hook/hoop arrangements of the attachment mechanisms 39, the user may manually unhook the attachment mechanisms 39. Other techniques for other types of attachment mechanisms 39 may be employed in order to detach the leg insulator 36 from the wader leg 33.

To enable the leg insulator 36 to be removed from the wader 30 without removing the user's legs from the wader legs 33, the leg insulators 36 preferably do not form a complete cylinder (i.e., a cylinder not having any lengthwise ends, such as ends 42 and 44, that extend from a top end to a bottom end of a leg insulator 36). In this regard, if the leg insulators 36 formed a complete cylinder, it can be appreciated by one of ordinary skill in the art that it would be difficult to remove the leg insulators 36 without removing the user's legs from the wader legs 33. Moreover, by having two lengthwise ends 42 and 44, it is possible to pull the leg insulator 36 out of the wader 30 with the user's leg passing between the two ends 42 and 44 thereby allowing the user to keep his or her leg in the wader leg 33 while the leg insulator 36 is being removed.

However, to increase the thermal insulation provided by the leg insulator 36, it may be desirable to encircle the user's leg as much as is conveniently possible. FIGS. 2–4 depict an embodiment where the each of the leg insulators 36 substantially encircles one of the user's legs. In this regard, each leg insulator 36 extends from at least the front of one of the user's leg to the back of the same leg.

Figure 5:
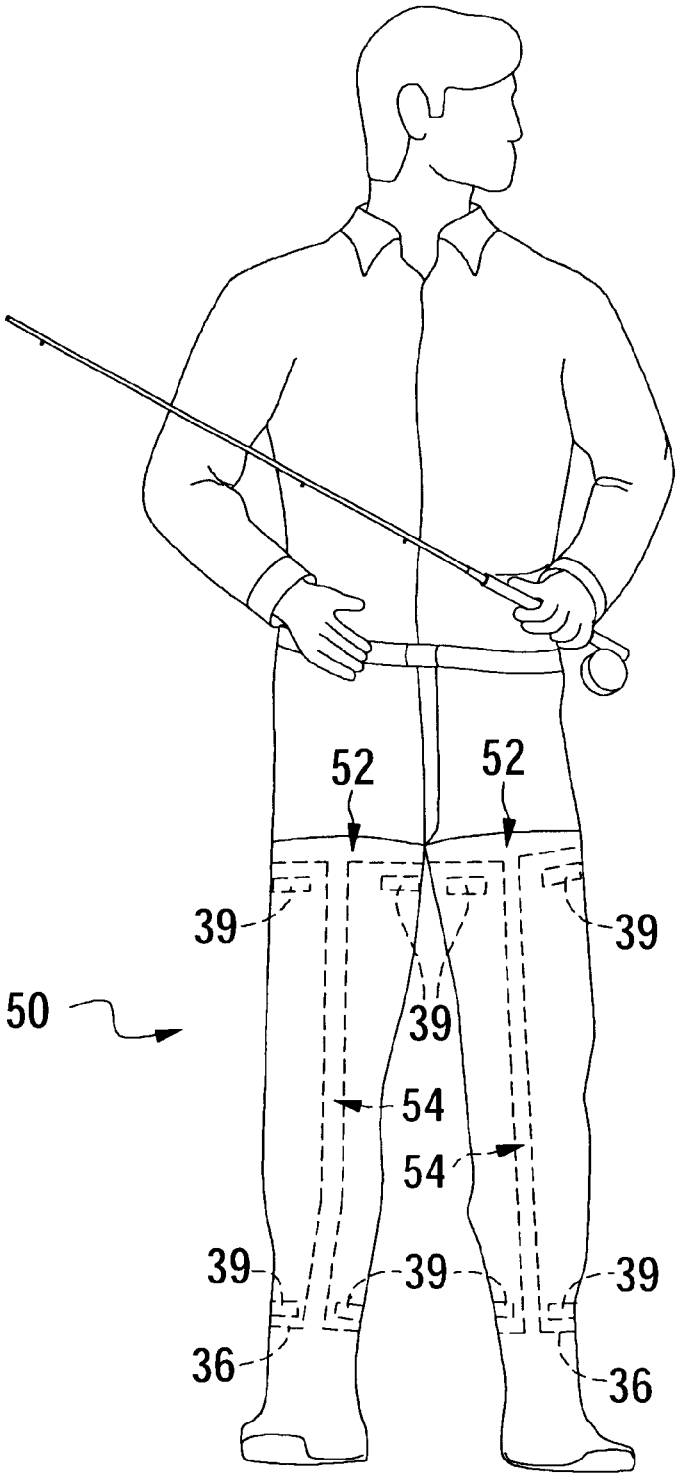
FIG. 5 is a diagram illustrating a wader in accordance with another embodiment of the present invention.
Figure 6:
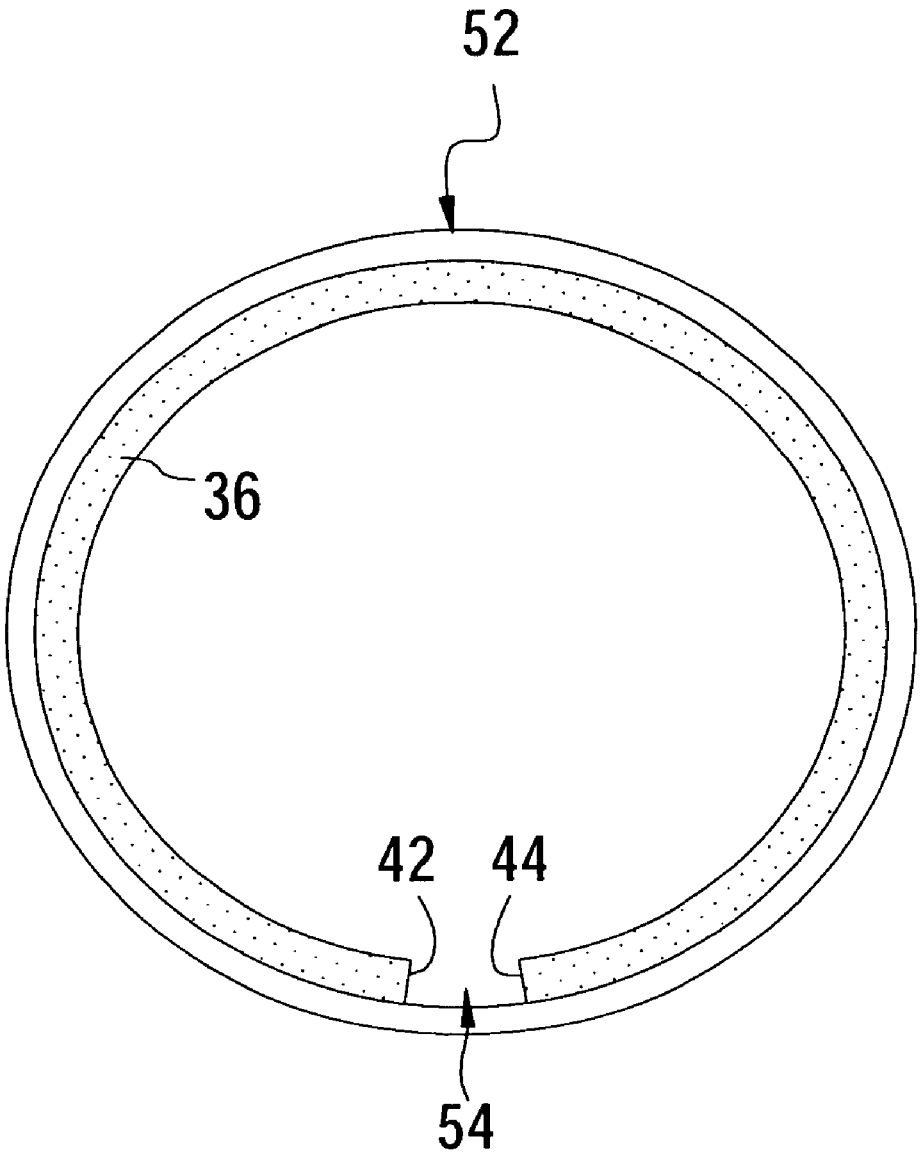
FIG. 6 is a diagram illustrating a top view of a wader leg depicted in FIG. 5.

Note that various types of other conventional waders may be employed in implementing the present invention. As an example, refer to FIG. 5, which depicts a wader 50 in accordance with another embodiment of the present invention. The wader 50 of FIG. 5 comprises two wader legs 52 that are separated from each other. A leg insulator 36 is positioned within each wader leg 52. In this embodiment, each leg insulator 36 extends all of the way around one of the user's legs except for a small gap 54 between the ends 42 and 44 of the leg insulator 36. Note that FIG. 6 depicts a top view of one of the wader legs 52 depicted in FIG. 5. Covering such a large area of the user's legs with the leg insulators 36 may be beneficial for increasing the thermal insulation provided by the leg insulators 36. Also, note that the same configuration and positioning of the leg insulators 36, as shown in FIGS. 5 and 6, may be employed with the wader 30 shown in FIG. 2.

In addition, the preferred embodiment of the present invention has been described as inserting leg insulators 36 within wader legs 33 or 52. However, in other embodiments, it is possible for the leg insulators 36 to be positioned on the outside of the wader legs 33 or 52. However, such an arrangement may provide less thermal insulation and may require the use of more expensive materials. In this regard, the leg insulators 36 would be immersed within the water being waded through by the user and should, therefore, be comprised of water resistant material. In such an embodiment, the leg insulator 36 should be detachably coupled to the wader leg 33 or 52 via any suitable technique, such as the techniques described hereinabove for detachably securing the leg insulators 36 to the waders legs 33 or 52 or to the user's legs.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A wader, comprising:

a wader leg; and a leg insulator having means for detachably coupling with said wader leg, said leg insulator capable of being removed from said wader leg while a user's leg is positioned within and remains within said wader leg wherein the leg insulator is positioned such that said leg insulator substantially encircles and substantially covers the user's leg;

wherein said leg insulator has a first side end and a second side end, said first side end juxtaposed with said second side end, wherein each of said ends is positioned within said wader leg, and wherein said first and second side ends are separated by a gap.

2. The wader of claim 1, wherein said leg insulator has a top end and a bottom end, said top end substantially encircling said user's leg and said bottom end substantially encircling said user's leg, said first side end extending from said top end to said bottom end and said second side end extending from said top end to said bottom end.

3. The wader of claim 2, wherein said user's leg passes between said first side end and said second side end as said leg insulator is being removed from said wader leg.

4. A method, comprising the steps of:

providing a wader, said wader having a wader leg;

inserting a leg insulator into said wader leg that is detachably coupled thereto;

inserting a user's leg into said wader leg;

positioning said leg insulator such that said leg insulator thermally insulates and substantially cover the user's leg when the user's leg is inserted into said wader leg; and removing said leg insulator from said wader leg while the user's leg is inserted into and remains within said wader leg wherein said leg insulator has a first side end and a second side end, wherein said positioning step comprises the step of positioning each of said ends within said wader leg, wherein the method further comprises the step of juxtaposing said first side end with said second side end such that said first and second side ends are separated by a gap.

5. The method of claim 4, wherein said leg insulator has a top and a bottom end, wherein each of said first and second side ends extends from said top end to said bottom end, wherein said positioning step comprises the step of substantially encircling the user's leg with said top end and said bottom end, and wherein said inserting step comprises the step of inserting said bottom end, said first end, and said second end into said wader leg.

6. The method of claim 5, wherein said removing step comprises the step of passing the user's leg between said first and second side ends.

7. A wader, comprising:

a wader leg; and a leg insulator that is detachably coupled with said wader leg, said leg insulator capable of being removed from said wader leg while a user's leg is positioned within and remains within the wader leg;

wherein said leg insulator has a top end, a bottom end, a first side end, and a second side end, said top end substantially encircling said user's leg and said bottom end substantially encircling said user's leg, said first side end extending from said top end to said bottom end and said second side end extending from said top end to said bottom end, wherein each of said first and second side ends is positioned within said wader leg, and wherein said first and second side ends are separated by a gap.

* * * * *